US005920953A

United States Patent [19]

Shero

[11] Patent Number: 5,920,953

[45] Date of Patent: Jul. 13, 1999

[54] CARPET AND UPHOLSTERY CLEANER/ EXTRACTOR

[75] Inventor: William K. Shero, deceased, late of Pueblo, Colo., by Pamela Shero, executrix

[73] Assignee: Windsor Industries, Inc., Englewood, Colo.

[21] Appl. No.: 08/900,395

[22] Filed: Jul. 21, 1997

[51] Int. Cl.[6] ..... A47L 9/22

[52] U.S. Cl. ..... 15/327.2; 15/321; 15/412

[58] Field of Search ..... 15/320, 321, 412, 15/327.2

[56] References Cited

U.S. PATENT DOCUMENTS

| | | | |
|---|---|---|---|
| 3,334,370 | 8/1967 | Boyd | 15/327.2 |
| 3,774,261 | 11/1973 | Colt . | |
| 4,068,340 | 1/1978 | Forward | 15/321 |
| 4,109,340 | 8/1978 | Bates . | |
| 4,153,968 | 5/1979 | Perkins . | |
| 4,195,969 | 4/1980 | Whitney | 15/412 X |
| 4,207,649 | 6/1980 | Bates . | |
| 4,284,127 | 8/1981 | Collier et al. . | |
| 4,336,627 | 6/1982 | Bascus . | |
| 4,433,909 | 2/1984 | Goes In Center et al. . | |
| 4,651,380 | 3/1987 | Ogden | 15/321 |
| 4,949,424 | 8/1990 | Shero . | |
| 5,615,448 | 4/1997 | Crouser et al. | 15/321 |

*Primary Examiner*—Chris K. Moore
*Attorney, Agent, or Firm*—Sheridan Ross P.C.

[57] ABSTRACT

A cleaning and extracting unit which includes a housing comprising upper and lower housing sections removably attached to each other. When attached to each other, the lower and upper housing sections collectively define a pair of vacuum pump chambers and a fluid pump chamber. The unit may be provided with one vacuum pump which is received into one of the vacuum pump chambers, or a pair of vacuum pumps which are connected to each other in series and received into respective ones of the vacuum pump chambers. The unit is also provided with a fluid pump which is received into the fluid pump chamber, as well as a heater which is received into a heater chamber defined by the lower housing section. The housing is sized and configured such that the vacuum pump(s) is/are maintained in the vacuum pump chamber(s) and the fluid pump is maintained in the fluid pump chamber by the compressive pressure exerted against the vacuum pump(s) and the fluid pump by the upper housing section when attached to the lower housing section.

18 Claims, 4 Drawing Sheets

CARPET AND UPHOLSTERY CLEANER/ EXTRACTOR

FIELD OF THE INVENTION

The present invention relates generally to carpet cleaning systems, and more particularly to a carpet and upholstery cleaner/extractor unit comprising a housing which is formed to accommodate components including one or more vacuum pumps, a fluid pump, and a heater without requiring the use of mounting brackets and/or fasteners to secure such components within the housing, thus making the unit inexpensive to manufacture and field repairable and modifiable through the quick and easy interchangability of the components and the capacity to add components thereto.

BACKGROUND OF THE INVENTION

Carpet and upholstery cleaning systems are generally well known in the prior art. Typically, these cleaning systems comprise a fluid pump which, when activated, directs a source of water or a solution consisting of a mixture of water and a cleaning agent through a heater and into a hand-held cleaning wand for application to a carpet or piece of upholstered furniture. The wand includes a trigger mechanism that controls the flow of water or solution from an exhaust port formed thereon. The wand also defines a vacuum suction inlet port which draws residual waste water back to a waste water recovery tank which is maintained under a vacuum by one or more motor driven vacuum pumps fluidly coupled thereto. In this respect, certain prior art cleaning systems include a single vacuum pump, with others including a pair of vacuum pumps connected to each other in series so as to provide a greater level of residual waste water suction from the wand.

In prior art cleaning systems, the waste water recovery tank, water/solution tank, fluid pump, heater and vacuum pump(s) are typically maintained within a housing. The housing includes a pair of couplings extending therefrom for facilitating the fluid connection of the wand to the waste water recovery tank and to the water/solution tank (typically via the fluid pump and heater). The housing is formed to include an interior cavity or recess which accommodates the various components of the cleaning system, including the fluid pump, heater, and vacuum pump(s). In the prior art cleaning systems, these components are secured within the housing, and in particular the cavity or recess defined therein, through the use of combinations of mounting brackets and fasteners such as nuts and bolts.

The use of mounting brackets and fasteners to maintain the various cleaning system components within the housing presents certain disadvantages which are overcome by the carpet and upholstery cleaner/extractor unit of the present invention. These deficiencies include the relatively high cost of manufacturing the prior art cleaning systems in view of the time and labor needed to mount the various components within the housing through the use of the mounting brackets and fasteners. Additionally, it is often desirable to make field repairs or modifications to the cleaning system, with such modifications including increasing the suction capacity of the wand by adding an additional vacuum pump thereto which is fluidly connected in series to the existing vacuum pump. In the prior art cleaning systems, field repairs or modifications are impractical due to the complexity of interchanging the components thereof, as well as the housing not being designed to accommodate an additional vacuum pump.

As previously indicated, the present invention overcomes these and other deficiencies of prior art cleaning systems by providing a carpet and upholstery cleaner/extractor unit wherein various components thereof, including a fluid pump, heater, and vacuum pump(s) are maintained within a housing without the use of mounting brackets or fasteners such as nuts and bolts. This design of the housing allows for the field repair of the unit since the components thereof may be quickly and easily interchanged without requiring the use of tools. The housing is further configured to accommodate an additional vacuum pump which may be retrofitted to the unit in a quick and easy manner as well, thus allowing for the field modification of the unit for purposes of increasing the suction capacity thereof.

SUMMARY OF THE INVENTION

In accordance with the present invention, there is provided a cleaning and extracting unit which comprises a housing including lower and upper housing sections removably attached to each other. When attached to each other, the lower and upper housing sections collectively define at least one vacuum pump chamber, and preferably a pair of vacuum pump chambers, as well as a fluid pump chamber. In this respect, the unit may be provided with one vacuum pump which is received into one of the vacuum pump chambers, or a pair of vacuum pumps which are connected to each other in series and received into respective ones of the vacuum pump chambers. The unit is also provided with a fluid pump which is received into the fluid pump chamber, and a heater which is received into a heater chamber defined by the lower housing section. In the preferred embodiment, the housing is sized and configured such that the vacuum pump(s) is/are maintained in the vacuum pump chamber(s) and the fluid pump is maintained in the fluid pump chamber solely by the compressive pressure exerted against the vacuum pump(s) and the fluid pump by the upper housing section when attached to the lower housing section.

The upper housing section further defines a recovery tank which is fluidly connected to the sole vacuum pump or one of the vacuum pumps of the pair, with the lower housing section defining an exhaust port which is fluidly connected to the sole vacuum pump, or the vacuum pump of the pair which is not fluidly connected to the recovery tank. The unit also preferably includes two or more sealing members which are disposed between the upper housing section and respective ones of the vacuum pump(s) and the fluid pump when the upper housing section is attached to the lower housing section for purposes of creating a sealed, cushioned interface between the upper housing section and the vacuum pump(s) and the fluid pump. Each of the sealing members is preferably fabricated from rubber, though similar materials may be employed in the present invention. Additionally, preferably disposed between the vacuum pump or one of the vacuum pumps of the pair and a respective one of the sealing members is a spacer member which is itself preferably fabricated from a polymer material, and used to fill a void within the associated vacuum pump chamber.

In the cleaning and extracting unit of the present invention, the manner in which the vacuum pump(s) and fluid pump are maintained within the housing eliminates the need to employ the use of mounting brackets and/or fasteners to secure such components within the housing. As such, the present unit may be field repaired since the vacuum pump(s), fluid pump, or heater may be quickly and easily interchanged without requiring the use of tools. Additionally, since the housing of the present unit is configured to accommodate one or two vacuum pumps, the unit may be quickly and easily field modified/retrofitted to include a second vacuum pump for purposes of increasing the suction capacity thereof. The absence of mounting brackets and/or fasteners also makes the present unit significantly less costly to manufacture than prior art cleaning systems due to the reduced time and labor need to complete the assembly thereof.

BRIEF DESCRIPTION OF THE DRAWINGS

These, as well as other features of the present invention, will become more apparent upon reference to the drawings wherein.

DETAILED DESCRIPTION OF THE PREFERRED EMBODIMENT

Figure 1:
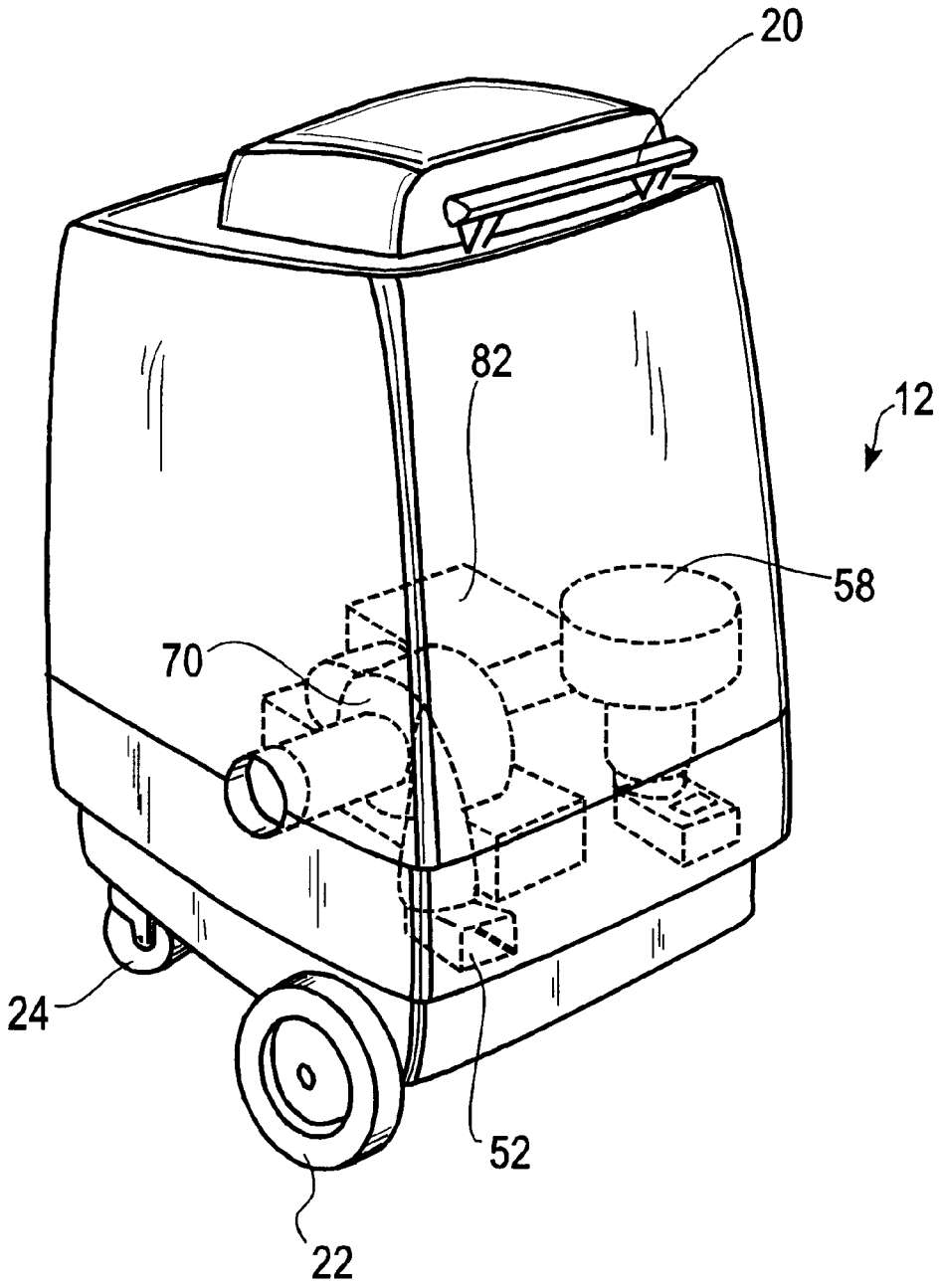
FIG. 1 is a rear perspective view of the cleaning and extracting unit constructed in accordance with the present invention.

Referring now to the drawings wherein the showings are for purposes of illustrating a preferred embodiment of the present invention only and not for purposes of limiting the same, FIG. 1 perspectively illustrates the carpet and upholstery cleaning and extracting unit 10 constructed in accordance with the present invention. Referring now to FIGS. 1–5, the unit 10 comprises a main housing 12 which is preferably fabricated from a plastic material and itself comprises a lower housing section 14 and an upper housing section 16. The lower and upper housing sections 14, 16 are preferably pivotally connected to each other through the extension of fasteners such as pivot pins through the coaxially aligned apertures of corresponding pairs of mounting lugs 18 formed on the lower and upper housing sections 14, 16. As will be recognized, pivoting the upper housing section 16 upwardly away from the lower housing section 14 effectively detaches the upper housing section 16 from the lower housing section 14. Conversely, pivoting the upper housing section 16 downwardly into contact with the lower housing section 14 effectively re-attaches the lower and upper housing sections 14, 16 to each other. Though not shown, the lower and upper housing sections 14, 16 are preferably provided with a latching mechanism to maintain them in attached engagement to each other. Additionally, as best seen in FIG. 1, the upper housing section 16 is preferably provided with a handle 20, with the lower housing section 14 being provided with a pair of wheels 22 and a pair of casters 24 to assist in the transport thereof to a desired location.

Figure 2:
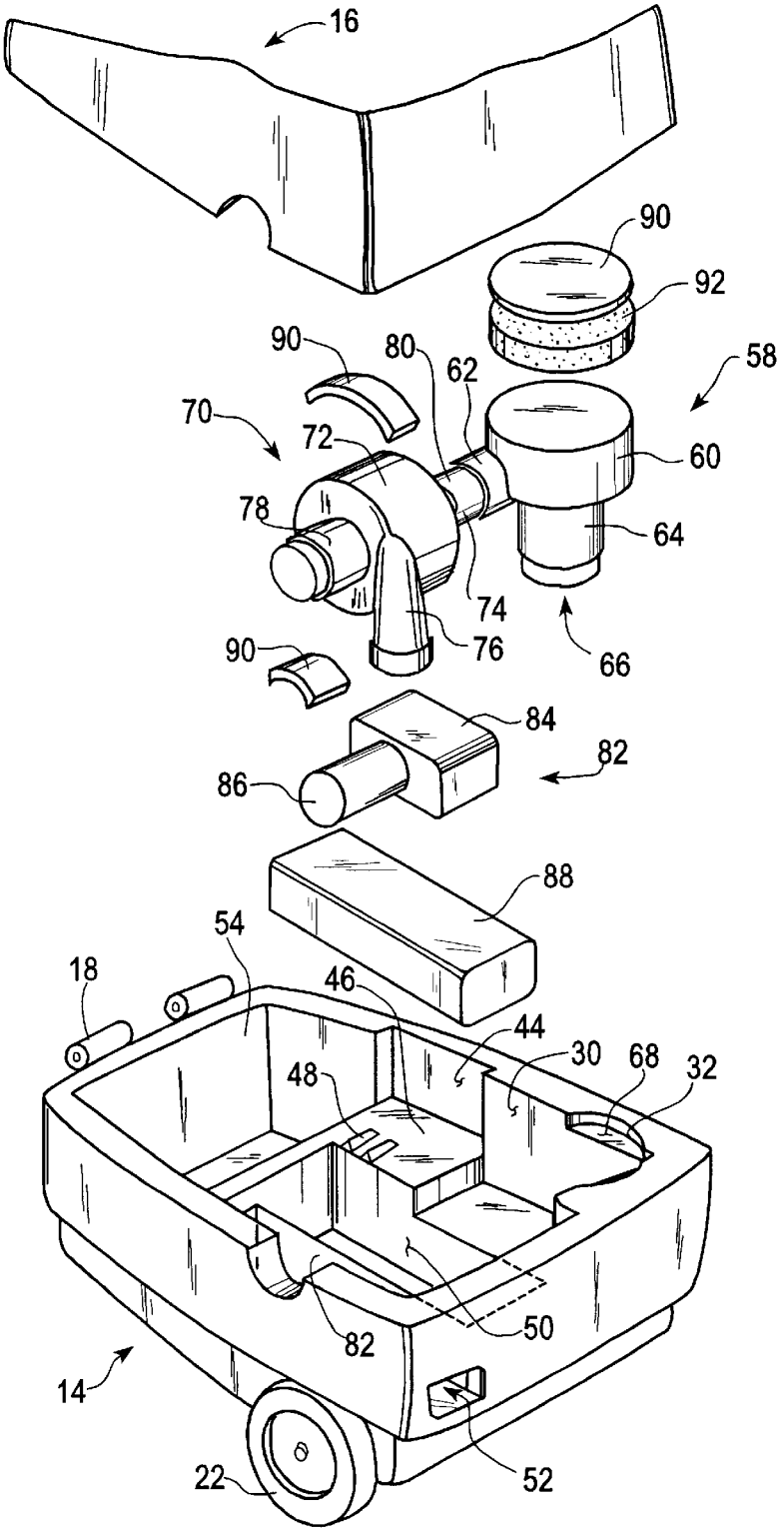
FIG. 2 is an exploded view of the cleaning and extracting unit shown in FIG. 1.

In the preferred embodiment, the lower and upper housing sections 14, 16, when attached to each other, collectively define a number of voids or chambers within the interior of the housing 12 for accommodating various components of the unit 10. More particularly, as seen in FIGS. 2–5, the lower and upper housing sections 14, 16 collectively define a first vacuum pump chamber 26, portions of which are defined by a first upper recess 28 formed within the upper housing section 16, and a first lower recess 30 formed within the lower housing section 14. As seen in FIG. 2, the first lower recess 30 defines a semi-circularly configured section 32, the use of which will be described in more detail below.

Figure 4:
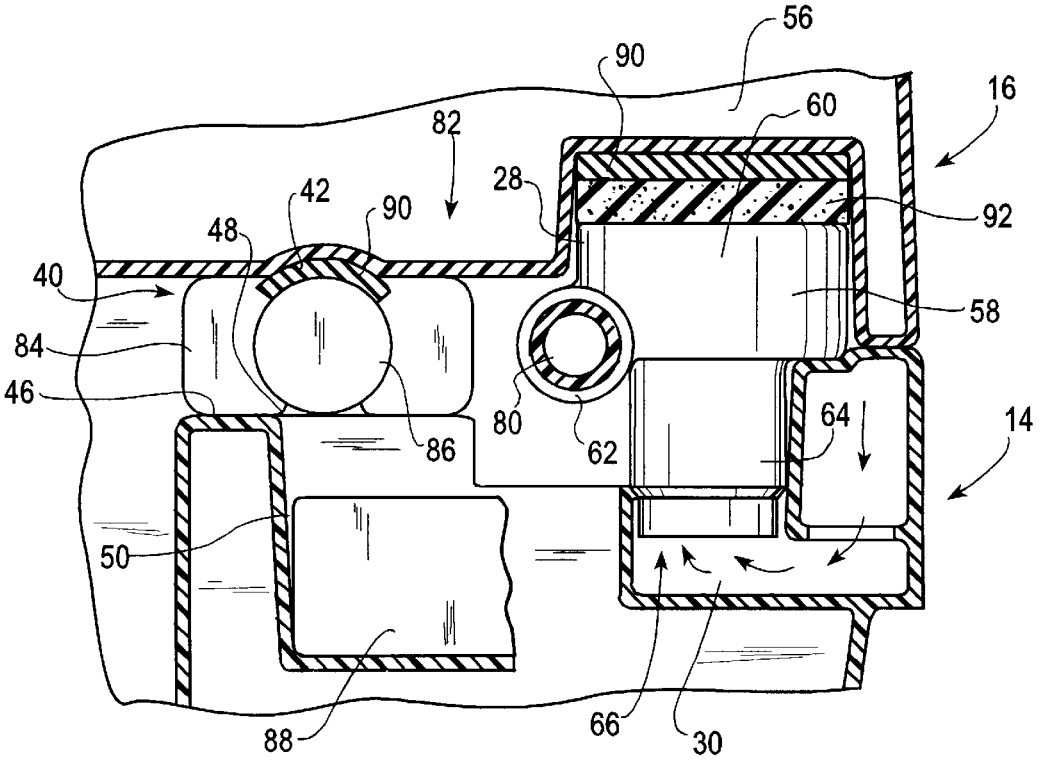
FIG. 4 is a cross-sectional view taken along line 4—4 of FIG. 1.
Figure 5:
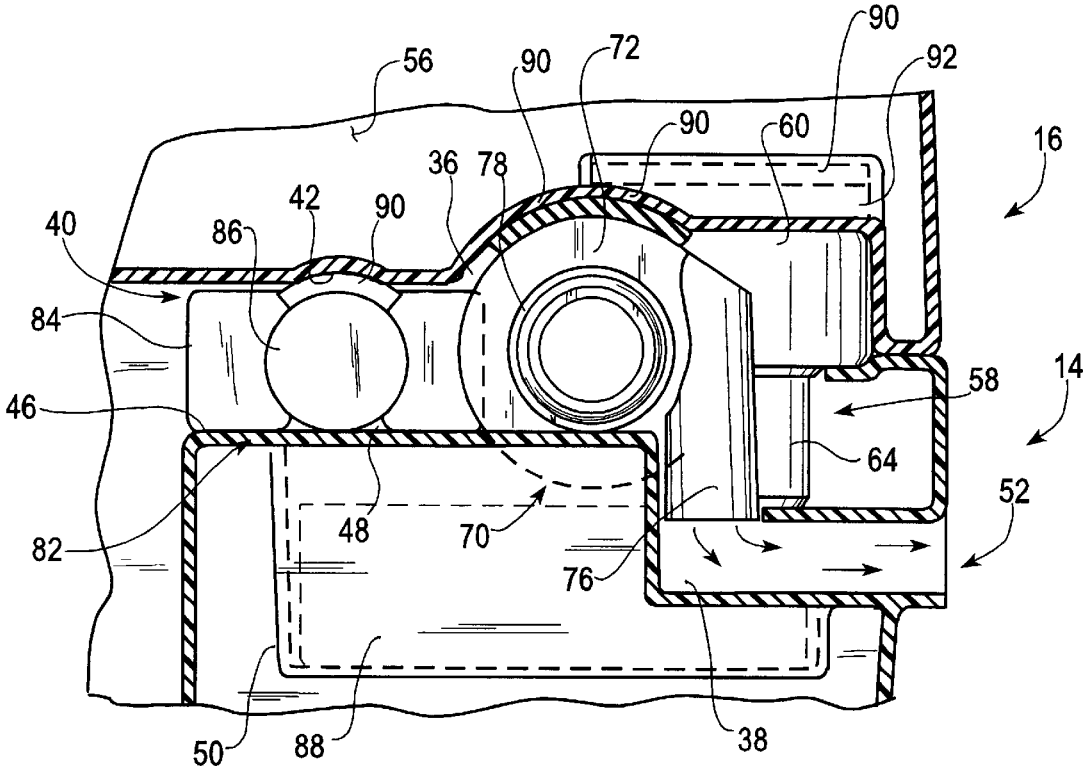
FIG. 5 is a cross-sectional view taken along line 5—5 of FIG. 1.

In addition to the first vacuum pump chamber 26, the lower and upper housing sections 14, 16 collectively define a second vacuum pump chamber 34, portions of which are defined by an arcuately contoured second upper recess 36 formed within the upper housing section 16, and a second lower recess 38 formed within the lower housing section 14. As best seen in FIGS. 2, 4 and 5, and lower and upper housing sections 14, 16 further collectively define a fluid pump chamber 40, portions of which are defined by an arcuately contoured third upper recess 42 formed within the upper housing section 16, and a third lower recess 44 formed within the lower housing section 14. As further seen in FIGS. 2, 4 and 5, the third lower recess 44 is itself partially defined by a bottom wall 46 of the lower housing section 14 which includes a spaced pair of ribs 48 formed thereon and extending partially therealong in generally parallel relation to each other. The use of the ribs 48 will also be described in more detail below.

Figure 3:
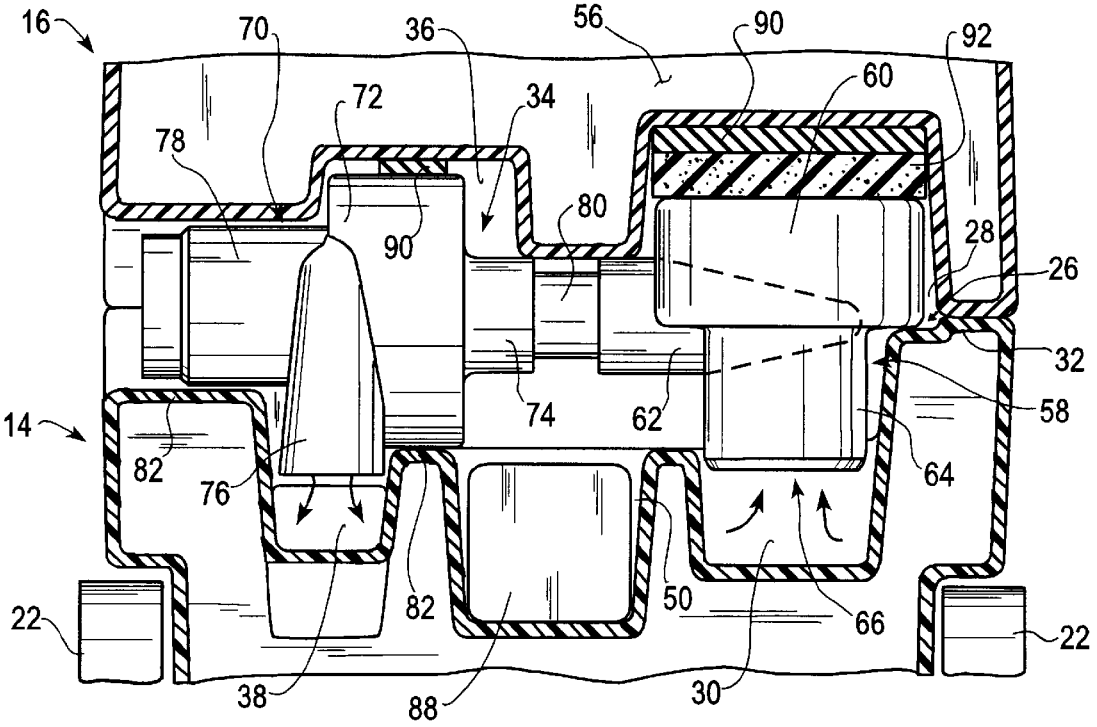
FIG. 3 is a cross-sectional view taken along line 3—3 of FIG. 1.

In addition to defining portions of the first and second vacuum pump chambers 26, 34 and fluid pump chamber 40, the lower housing section 14 itself defines a generally rectangularly configured heater chamber 50, which is best shown in FIGS. 2–4. Additionally, as seen in FIGS. 2 and 5, the lower housing section 14 defines an exhaust port 52 which fluidly communicates with the second lower recess 38 partially defining the second vacuum pump chamber 34. As further seen in FIG. 2, the lower housing section 14 defines a tank chamber 54 for at least partially accommodating a water/cleaning solution tank of the unit 10. As seen in FIGS. 3–5, the upper housing section 16 itself further defines a waste water recovery tank 56 which is located above the first, second and third upper recesses 28, 36, 42.

In the unit 10, the first vacuum pump chamber 26 collectively defined by the lower and upper housing sections 14, 16 when attached to each other is sized and configured to receive a first vacuum pump 58 of the unit 10. The first vacuum pump 58 includes a cylindrically configured upper section 60 having a tubular air exhaust port 62 tangentially communicating therewith. The first vacuum pump 58 further includes a cylindrically configured lower section 64 of reduced diameter which extends generally axially from the upper section 64 and defines an air intake port which fluidly communicates with the first lower recess 30 formed within the lower housing section 14.

The first vacuum pump 58 is placed within the housing 12 by initially inserting the lower section 64 thereof into the first lower recess 30 such that a peripheral portion of the bottom surface of the upper section 60 rests upon a shelf 68 defined by the lower housing section 14 adjacent the semi-circular section 32 thereof. In this respect, when the upper section 60 is rested upon the shelf 68, a peripheral portion of the upper section 60 is accommodated by the semi-circular section 32. When the upper section 60 is rested upon the shelf 68, the lower section 64 extends into the first lower recess 30, with the air intake port 66 thereof communicating with the first lower recess 30. The attachment of the upper housing section 16 to the lower housing section 14 causes that portion of the upper section 16 protruding upwardly from the first lower recess 30 to be received into the first upper recess 28 of the upper housing section 16, as best seen in FIGS. 3 and 4. As further seen in FIG. 4, the lower and upper housing sections 14, 16 collectively define an air channel which places the first lower recess 30, and hence the air intake port 66 of the first vacuum pump 58, into fluid communication with the recovery tank 56 defined by the upper housing section 16.

In addition to the first vacuum pump 58, the unit 10 of the present invention preferably includes a second vacuum pump 70 which is received into the second vacuum pump chamber 34 collectively defined by the lower and upper housing sections 14, 16 when attached to each other. As best seen in FIGS. 3 and 5, the second vacuum pump 70 includes a cylindrically configured inner section 72 which defines an air intake port 74 and includes a tubular air exhaust port 76 tangentially communicating therewith. The second vacuum pump 70 further includes a cylindrically configured outer section 78 which is of reduced diameter and extends generally axially from the inner section 72. In the unit 10, the air intake port 74 of the second vacuum pump 70 is fluidly connected to the air exhaust port 62 of the first vacuum pump 58 via a tubular coupling 80, as best seen in FIGS. 2 and 3. In this respect, the first and second vacuum pumps 58, 70 are connected to each other in series for purposes of providing the unit 10 with a greater suction capacity.

The receipt of the second vacuum pump 70 into the second vacuum pump chamber 34 is facilitated by initially inserting the second vacuum pump 70 into the second lower recess 38 of the lower housing section 14 such that the air exhaust port 76 fluidly communicates therewith. In this respect, when the air exhaust port 76 is received into the second lower recess 38, portions of the inner and outer sections 72, 78 of the second vacuum pump 70 rest upon respective ones of a pair of shelves 82 defined by the lower housing section 14 on opposite sides of the second lower recess 38, as best seen in FIG. 3. The subsequent attachment of the upper housing section 16 to the lower housing section 14 facilitates the receipt of a portion of the inner section 72 of the second vacuum pump 70 into the arcuately contoured second upper recess 36 formed within the upper housing section 16. By virtue of its fluid communication with the second lower recess 38, the air exhaust port 76 of the second vacuum pump 70 fluidly communicates with the exhaust port 52 formed within the lower housing section 14.

As best seen in FIGS. 1, 4 and 5, the fluid pump chamber 40 collectively defined by the lower and upper housing sections 14, 16 is adapted to receive a fluid pump 82. The fluid pump 82 includes a box-like first section 84 and a cylindrically configured second section 86 which extends from one side of the first section 84. The receipt of the fluid pump 82 into the fluid pump chamber 40 is facilitated by initially resting the first section 84 upon the bottom wall 46 of the lower housing section 14 which partially defines the third lower recess 44 such that the second section 86 extends between and rests against the ribs 48 formed on and extending upwardly from the bottom wall 46, in the manner shown in FIGS. 4 and 5. The subsequent re-attachment of the upper housing section 16 to the lower housing section 14 facilitates the placement of the arcuately contoured third upper recess 42 formed within the upper housing section 16 directly above the second section 86 of the fluid pump 82.

In addition to the first and second vacuum pumps 58, 70 and fluid pump 82, the unit 10 of the present invention includes a heater 88. The heater 88 has a generally rectangular configuration which is complementary to that of the heater chamber 50, and is adapted to be received into the heater chamber 50 such that it rests on the wall of the lower housing section 14 which defines the bottom of the heater chamber 50. As seen in FIG. 3, when the heater 88 is operatively positioned with the heater chamber 50, the heater 88 extends transversely relative to the coupling 80 fluidly interconnecting the first and second vacuum pumps 58, 70.

In the unit 10 constructed in accordance with the present invention, the first and second vacuum pumps 58, 70 and fluid pump 82 are maintained within respective ones of the first and second vacuum pump chambers 26, 34 and fluid pump chamber 40 solely by the compressive pressure exerted thereagainst by the upper housing section 16 when the same is secured to the lower housing section 14 in the manner shown in FIGS. 1 and 3–5. In this respect, portions of the first and second vacuum pump 58, 70 and fluid pump 82 are captured between various surfaces of the lower and upper housing sections 14, 16 defining respective ones of the first and second vacuum pump chambers 26, 34 and fluid pump chamber 40 when the lower and upper housing sections 14, 16 are engaged to each other, thus allowing these components of the unit 10 to be maintained within the main housing 12 without the use of mounting brackets and/or fasteners such as nuts and bolts.

In the preferred embodiment, the unit 10 of the present invention further includes three (3) sealing members 90 which are used to provide a sealed, cushioned interface between the upper housing section 16 and the first and second vacuum pumps 58, 70 and fluid pump 82 when the upper housing section 16 is compressed thereagainst. As seen in FIGS. 2–5, a first, rectangularly configured sealing member 90 is preferably placed upon the top of the cylindrically configured second section 86 of the fluid pump 82, and is compressed between the second section 86 and the upper housing section 16 when the upper housing section 16 is engaged to the lower housing section 14, as seen in FIGS. 4 and 5. A second, rectangularly configured sealing member 90 is preferably positioned on the top of the inner section 72 of the second vacuum pump 70 and is compressed between the inner section 72 and the upper housing section 16 when the upper housing section 16 is engaged to the lower housing section 14, as seen in FIGS. 3 and 5.

A third, circularly configured sealing member 90 is preferably positioned between the top of the upper section 60 of the first vacuum pump 58 and the upper housing section 16. However, as seen in FIGS. 3 and 4, when the upper housing section 16 is engaged to the lower housing section 14, the circular sealing member 90 is not compressed directly against the top of the upper section 60. Rather, such sealing member 90 is compressed between the upper housing section 16 and a circularly configured spacer member 92 which is rested upon the top surface of the upper section 60 of the first vacuum pump 58. In this respect, in the unit 10 it is contemplated that the first vacuum pump 58 may be provided in any one of a number of different sizes, with the first vacuum pump chamber 26, and in particular the first upper recess 28 partially defining the same, being sized to accommodate vacuum pumps of more than one size. If the first vacuum pump 58 is selected to be of a smaller size (i.e., create less of a suction force), the spacer member 92 is typically employed to fill the void which would otherwise be defined within the first upper recess 28 when the upper housing section 16 is engaged to the lower housing section 14, thus allowing the upper housing section 16 to exert compressive pressure against the first vacuum pump 58 via the circular sealing member 90 and spacer member 92. The inclusion of a larger size first vacuum pump 58 within the unit 10 will typically eliminate the requirement to include the spacer member 92, with the circular sealing member 90 being rested directly upon the top surface of the upper section 60, and compressed between the upper housing section 16 and upper section 60 when the upper housing section 16 is engaged to the lower housing section 14, rather than being compressed between the upper housing section 16 and spacer member 92. In the preferred embodiment, the sealing members 90 are each preferably fabricated from rubber, with the spacer member 92 preferably being fabricated from a polymer material. However, those of ordinary skill in the art will recognize that alternative materials may be employed for the sealing members 90 and spacer member 92.

In the unit 10 of the present invention, when the first and second vacuum pumps 58, 70, fluid pump 82 and heater 88 are received into respective ones of the first and second vacuum pump chambers 26, 34, fluid pump chamber 40 and heater chamber 50 in the previously described manner, the air intake port 66 of the first vacuum pump 58 is in fluid communication with the interior of the recovery tank 56, with the air exhaust port 76 of the second vacuum pump 70 being in fluid communication with the exhaust port 52 defined by the lower housing section 14. Additionally, the fluid pump 82 is in fluid communication with the heater 88, which is itself fluidly coupled to the water/cleaning solution tank of the unit 10.

Though not shown, the housing 12 includes a pair of couplings extending therefrom, one of which is fluidly connected to the fluid pump 82, with the other being fluidly connected to the interior of the recovery tank 56. A hank-held cleaning wand (not shown) is adapted to be connected to the couplings. The activation of the first and second vacuum pumps 58, 70 (which are connected in series) creates a vacuum within the interior of the recovery tank 56, with air being drawn from therewithin into the air intake port 66 of the first vacuum pump 58 and discharged from the air exhaust port 76 of the second vacuum pump 70 and out of the exhaust port 52. The connection of the cleaning wand to the unit 10 via the previously described couplings allows waste water to be drawn through the wand and into the recovery tank 56 due to the negative pressure therewithin. The activation of the fluid pump 82 causes water or cleaning solution to be drawn from the water/cleaning solution tank, through the heater 88, and circulated through the fluid pump 82 into the cleaning wand for selective application to carpet or piece of upholstery. The fluid pump 82 is preferably selected to provide a pump pressure of from 50 to 1000 psi, and a flow rate of approximately 1.5 gallons per minute. Additionally, the preferred heater 88 is adapted to heat the water or cleaning solution to a temperature in the range of 200° to 230° F. Further, the preferred first and second vacuum pumps 58, 70 are each adapted to provide about 20 HG (280 inches of water lift). However, those of ordinary skill in the art will recognize that components having differing specifications may be employed in the unit 10 of the present invention.

Though not shown, it is contemplated that the unit 10 may be provided with only the first vacuum pump 58 as opposed to the first and second vacuum pumps 58, 70 connected to each other in series. If the second vacuum pump 70 is excluded from the unit 10, air circulated through the first vacuum pump 58 is exhausted form the air exhaust port 62 thereof, and exits the housing 12 via the exhaust port 52 after circulating through the vacant second vacuum pump chamber 34. As will be recognized, both the first and second vacuum pumps, 58, 70 are employed in the unit 10 when a higher level of suction capacity is desired.

In the unit 10 of the present invention, the manner in which the first vacuum pump 58 (or combination of the first and second vacuum pumps 58, 70) and fluid pump 82 are maintained within the interior of the housing 12 eliminates the need to employ the use of mounting brackets and/or fasteners to secure such components within the housing 12. As such, the unit 10 may be field repaired since the first vacuum pump 58 alone or in combination with the second vacuum pump 70, fluid pump 82, and heater 88 may be quickly and easily interchanged without requiring the use of tools. Additionally, since the housing 12 of the unit 10 is configured to accommodate either the first vacuum pump alone or in combination with the second vacuum pump 70, the unit 10 may quickly and easily field modified/retrofitted to include the second vacuum pump 70 for purposes of increasing the suction capacity thereof. The absence of mounting brackets and/or fasteners also makes the unit 10 significantly less costly to manufacture than prior art cleaning systems due to the reduced time and labor needed to complete the assembly thereof.

Additional modifications and improvements of the present invention may also be apparent to those of ordinary skill in the art. Thus, the particular combination of parts described and illustrated herein is intended to represent only one embodiment of the present invention, and is not intended to serve as limitations of alternative devices within the spirit and scope of the invention.

What is claimed is:

1. A cleaning and extracting unit, comprising:

at least one vacuum pump;

a fluid pump; and a housing comprising:

a lower housing section; and an upper housing section removably attached to said lower housing section, said lower and upper housing sections collectively defining at least one vacuum pump chamber for receiving said vacuum pump and a fluid pump chamber for receiving said fluid pump when attached to each other;

said housing being sized and configured such that the vacuum pump is maintained in the vacuum pump chamber and the fluid pump is maintained in the fluid pump chamber by the compressive pressure exerted against the vacuum pump and the fluid pump by the upper housing section when attached to the lower housing section.

2. The unit of claim 1 further comprising a heater and a heater chamber defined by the lower housing section for receiving the heater.

3. The unit of claim 1 wherein the upper housing section defines a recovery tank which is fluidly connected to the vacuum pump and the lower housing section defines an exhaust port which is fluidly connected to the vacuum pump.

4. The unit of claim 1 further comprising at least two sealing members which are disposed between the upper housing section and respective ones of the vacuum pump and the fluid pump when the upper housing section is attached to the lower housing section for purposes of creating a sealed, cushioned interface between the upper housing section and the vacuum pump and the fluid pump.

5. The unit of claim 4 wherein each of the sealing members is fabricated from rubber.

6. The unit of claim 4 further comprising a spacer member which is disposed between the vacuum pump and a respective one of the sealing members.

7. The unit of claim 6 wherein the spacer member is fabricated from a polymer material.

8. The unit of claim 1 wherein:

said at least one vacuum pump comprises a pair of vacuum pumps; and said lower and upper housing sections collectively define a pair of vacuum pump chambers for receiving respective ones of said vacuum pumps when attached to each other;

said housing being sized and configured such that the vacuum pumps are maintained within the vacuum pump chambers by the compressive pressure exerted against the vacuum pumps by the upper housing section when attached to the lower housing section.

9. The unit of claim 8 wherein the upper housing section defines a recovery tank which is fluidly connected to one of the vacuum pumps of the pair and the lower housing section defines an exhaust port which is fluidly connected to the other vacuum pump of the pair.

10. The unit of claim 8 further comprising at least three sealing members which are disposed between the upper housing section and respective ones of the vacuum pumps and the fluid pump when the upper housing section is attached to the lower housing section for purposes of creating a sealed, cushioned interface between the upper housing section and the vacuum pumps and the fluid pump.

11. The unit of claim 10 wherein each of the sealing members is fabricated from rubber.

12. The unit of claim 10 further comprising a spacer member which is disposed between one of the vacuum pumps of the pair and a respective one of the sealing members when the upper housing section is attached to the lower housing section.

13. The unit of claim 12 wherein the spacer member is fabricated from a polymer material.

14. In a cleaning and extracting unit having at least one vacuum pump, a fluid pump, and a heater, the improvement comprising a housing which includes:

a lower housing section; and an upper housing section removably attached to said lower housing section, said lower and upper housing sections collectively defining at least one vacuum pump chamber for receiving said vacuum pump and a fluid pump chamber for receiving said fluid pump when attached to each other;

said housing being sized and configured such that the vacuum pump is maintained in the vacuum pump chamber and the fluid pump is maintained in the fluid pump chamber by the compressive pressure exerted against the vacuum pump and the fluid pump by the upper housing section when attached to the lower housing section.

15. The unit of claim 14 wherein the lower housing section further defines a heater chamber for receiving the heater.

16. The unit of claim 14 wherein the upper housing section defines a recovery tank which is fluidly connected to the vacuum pump and the lower housing section defines an exhaust port which is fluidly connected to the vacuum pump.

17. The unit of claim 14 wherein said lower and upper housing sections collectively define a pair of vacuum pump chambers for receiving respective ones of a pair of vacuum pumps when attached to each other, said housing being sized and configured such that the vacuum pumps are maintained within the vacuum pump chambers by the compressive pressure exerted against the vacuum pumps by the upper housing section when attached to the lower housing section.

18. The unit of claim 17 wherein the upper housing section defines a recovery tank which is fluidly connected to one of the vacuum pumps of the pair and the lower housing section defines an exhaust port which is fluidly connected to the other vacuum pump of the pair.

* * * * *